US006747621B2

(12) United States Patent
Miyake

(10) Patent No.: US 6,747,621 B2
(45) Date of Patent: Jun. 8, 2004

(54) LIQUID CRYSTAL DISPLAY DEVICE WITH DRIVING SIGNAL CONTROL FUNCTION

(75) Inventor: Shiro Miyake, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 229 days.

(21) Appl. No.: 09/930,498

(22) Filed: Aug. 16, 2001

(65) Prior Publication Data

US 2002/0047821 A1 Apr. 25, 2002

(30) Foreign Application Priority Data

Aug. 18, 2000 (JP) ..... 2000-248616

(51) Int. Cl.[7] ..... G09G 3/36
(52) U.S. Cl. ..... 345/87; 345/89
(58) Field of Search ..... 345/87, 89, 58, 345/92, 94, 100, 204, 101, 160, 213; 348/790, 670; 349/33, 41, 42

(56) References Cited

U.S. PATENT DOCUMENTS 4,243,987 A * 1/1981 Bobick ..... 345/160
6,326,943 B1 * 12/2001 Inoue et al. ..... 345/101
6,337,682 B1 * 1/2002 Hwang ..... 345/213
6,556,180 B1 * 4/2003 Furuhashi et al. ..... 345/87
2001/0024181 A1 * 9/2001 Kubota et al. ..... 345/87

FOREIGN PATENT DOCUMENTS

JP 2553713 8/1996
JP 2616652 3/1997

* cited by examiner

*Primary Examiner*—Chanh Nguyen
(74) *Attorney, Agent, or Firm*—McDermott, Will & Emery

(57) ABSTRACT

The invention relates to a liquid crystal display device, comprising a memory that delays a current display data supplied to a liquid crystal panel by one display period, and a reference table memory that holds a reference data containing multiple reference values determined by the current display data and a delayed display data. Here, the reference table memory has a compensation signal data written in advance, which substantially completes an optical response of the liquid crystal panel within the one display period. The liquid crystal display device supplies the inputted display data after having been converted always into a compensated signal level data to the liquid crystal panel, thus achieving a high-speed response that is completed within the one display period.

3 Claims, 6 Drawing Sheets

FIG. 3

| Address (Delayed display date DDD : 8 bits) | Address (Current display data RDD : 8 bits) | | | | | | | | | | | | | | |
|---|---|---|---|---|---|---|---|---|---|---|---|---|---|---|---|
| | 0 | 1 | 2 | 3 | 4 | 5 | | | | 250 | 251 | 252 | 253 | 254 | 255 |
| 0 | 0 | 2 | 4 | 6 | 8 | 9 | | | | 252 | 253 | 254 | 255 | 255 | 255 |
| 1 | 0 | 1 | 2 | 5 | 7 | | | | | | 253 | 254 | 255 | 255 | 255 |
| 2 | 0 | 0 | 2 | 4 | 6 | | | | | | 253 | 254 | 255 | 255 | 255 |
| 3 | 0 | 1 | 1 | 3 | 4 | | | | | | 253 | 254 | 255 | 255 | 255 |
| 4 | 0 | 2 | 3 | 3 | | | | | | | | 254 | 255 | 255 | 255 |
| 5 | 0 | | | | | | | | | | | | | | 255 |
| 250 | 0 | | | | | | | | | | | | | | 255 |
| 251 | 0 | 0 | 0 | 1 | | | | | | | 251 | 253 | 255 | 255 | 255 |
| 252 | 0 | 0 | 0 | 1 | 2 | | | | | | 250 | 252 | 255 | 255 | 255 |
| 253 | 0 | 0 | 0 | 1 | 2 | | | | | | 250 | 251 | 253 | 255 | 255 |
| 254 | 0 | 0 | 0 | 1 | 2 | | | | | | 249 | 250 | 252 | 254 | 255 |
| 255 | 0 | 0 | 0 | 1 | 2 | 3 | | | | 247 | 249 | 250 | 252 | 254 | 255 |

FIG. 4

| Address (Delayed display date DDD : 8 bits) | Address (Current display data RDD : 8 bits) | | | | | | | | | | | | | | |
|---|---|---|---|---|---|---|---|---|---|---|---|---|---|---|---|
| | 0 | 1 | 2 | 3 | 4 | 5 | | | | 250 | 251 | 252 | 253 | 254 | 255 |
| 0 | 0 | 2 | 4 | 6 | 8 | 9 | | | | 252 | 253 | 254 | 255 | 255 | 255 |
| 1 | 0 | 1 | 2 | 5 | 7 | | | | | | 253 | 254 | 255 | 255 | 255 |
| 2 | 0 | 0 | 2 | 4 | 6 | | | | | | 253 | 254 | 255 | 255 | 255 |
| 3 | 0 | 1 | 1 | 3 | 4 | | | | | | 253 | 254 | 255 | 255 | 255 |
| 4 | 0 | 2 | 3 | 3 | | | | | | | | 254 | 255 | 255 | 255 |
| 5 | 0 | | | | | | | | | | | | | | 255 |
| 250 | 0 | | | | | | | | | | | | | | 210 |
| 251 | 0 | 0 | 0 | 1 | 2 | | | | | | 196 | 198 | 200 | 205 | 208 |
| 252 | 0 | 0 | 0 | 1 | 2 | | | | | | 195 | 197 | 200 | 204 | 206 |
| 253 | 0 | 0 | 0 | 1 | 2 | | | | | | 195 | 196 | 198 | 200 | 204 |
| 254 | 0 | 0 | 0 | 1 | 2 | | | | | | 194 | 195 | 197 | 199 | 202 |
| 255 | 0 | 0 | 0 | 1 | 2 | 3 | | | | 192 | 194 | 195 | 197 | 199 | 200 |

LIQUID CRYSTAL DISPLAY DEVICE WITH DRIVING SIGNAL CONTROL FUNCTION

BACKGROUND OF THE INVENTION

1. Field of the Invention

The present invention relates to a liquid crystal display device using a liquid crystal panel.

2. Related Art

A liquid crystal panel switches display levels of a picture by switching electrical signals from outside. The liquid crystal panel usually receives display data from outside, converts the display data into electrical signal waveforms of predetermined voltage levels, and applies the waveforms to the liquid crystal elements to thereby display a picture. The switching time of the display levels by the liquid crystal panel is some 10 ms in general.

FIG. 7 illustrates an example of response waveform when an electrical signal is applied to one liquid crystal element. In FIG. 7(*a*), an electrical signal waveform 101 illustrates a voltage applied to the liquid crystal element. The horizontal axis represents the time and the vertical axis represents the signal level. T1 represents a period of time during which a low signal level 1 is supplied. T2 represents a period of time during which a high signal level 2 is supplied. In FIG. 7(*b*), an optical response waveform 102 represents an optical response waveform of the liquid crystal element when the voltage of the electrical signal waveform 101 is applied, the horizontal axis represents the time corresponding to the electrical signal waveform, and the vertical axis represents the level of light transmittance of the liquid crystal element. The light transmittance shows a low level 1 during the period T1, and a high level 2 during the period T2.

When the signal level of the electrical signal waveform 101 is switched from the low signal level 1 into the high signal level 2, a transitional period T3 appears between the period T1 and the period T2, due to the delay in the optical response of the liquid crystal element. When the light transmittance level 1 is 0%, and the light transmittance level 2 is 100%, the time required for the light transmittance varying from 10% to 90% is called the rise response time or response speed of the liquid crystal panel. Also, when the signal level is switched from the high signal level 2 into the low signal level 1, the time required for the light transmittance varying from 90% to 10% is similarly called the fall response time of the liquid crystal panel.

Usually, the liquid crystal display device is driven by TV signals or signals from the personal computers, and the display switching frequency of these signals are about 60 Hz in general. This means that the display period of one picture screen is approximately 16.7 ms, and the picture screen is always rewritten by this time interval. On the other hand, the response speed of the liquid crystal element of the liquid crystal panel is around 30 to 60 ms in general. Therefore, the response is not complete within the time equivalent to the display switching frequency of 60 Hz.

As a method of improving such slowness in the response time of a liquid crystal panel, for example, a method of accelerating the movement of a liquid crystal element by temporarily applying a higher or lower signal level at the switching time of a drive signal of the liquid crystal panel has been proposed in the Japanese patent No. 2616652. This method is a technique applied to a liquid crystal panel of the Super Twisted Nematic (STN) mode, wherein the response speed of the liquid crystal element is rather slow as some 100 ms. This technique is effective for the liquid crystal panels with slow response speeds, for example, when the response waveform of the drive electrical signal waveform and the liquid crystal panel using this technique will improve the response speed from an optical response waveform 102 to an optical response waveform 102*a* as shown in FIG. 8. FIG. 8(*a*) illustrates the signal level variation of the electrical signal waveform 101, and FIG. 8(*b*) illustrates the optical response waveforms 102, 102*a* that represent the variations of the light transmittance corresponding to the signal level variation. "A" in FIG. 8(*a*) represents the level of compensation, and the waveform 102 in FIG. 8(*b*) shows the optical response waveform when not compensated, and the waveform 102*a* shows the optical response waveform when compensated.

However, when this technique is applied to a liquid crystal panel with a comparably high response speed of the liquid crystal element as some 10 ms, such as the recent TFT-LCD using a thin film transistor, for example, when the electrical signal waveform 101 is switched from the low voltage level into the high voltage as shown in FIG. 9(*a*), there is a possibility that an overshooting occurs in the optical response waveform 102, as shown in FIG. 9(*b*), which is not desirable in terms of visibility of the display. On the other hand, when the voltage level is switched from the high level to the low level, there is a possibility that an undershooting occurs.

Furthermore, when the signal level after switching the display reaches the highest level, the compensation signal with a level higher than this highest level cannot be generated, which leads to a problem that disables improvement of the response speed.

SUMMARY OF THE INVENTION

According to one aspect of the invention, the liquid crystal display device includes: a delay circuit that delays an inputted current display data by one display period and outputs a delayed display data; a reference unit that possesses a reference data containing a plurality of reference values corresponding to both the current display data and the delayed display data, and outputs an output data based on a reference value selected from the plurality of the reference values; and a liquid crystal panel that receives a supply of video signals on the basis of the output data. Further, the reference value selected when the current display data changes from the delayed display data is set so that an optical response of the liquid crystal panel in relation to the change is substantially completed within the one display period.

Thus, the liquid crystal device of the invention is provided with a reference circuit that possesses a reference data containing a plurality of reference values corresponding to both the current display data and the delayed display data, and with regard to all the combinations of the current display data and the delayed display data, the data are prepared in advance, with which the optical response of a liquid crystal element is completed within the one display period neither too much nor too less. Thereby, the optical response of the liquid crystal element of the liquid crystal panel can be completed within the one display period without generating an overshooting or an undershooting at any data level changes.

According to another aspect of the invention, in the liquid crystal display device, the level of the output data is compressed by a specific depth in such a manner that the level of the output data when the delayed display data and the current display data have the same value becomes lower than the level of the current display data, and the reference value selected when the current display data becomes higher than the delayed display data is set to expand the output data within the specific depth.

According to this, if the level of the current display data has a maximum level, it is possible to expand the output data within the specific depth, whereby the optical response of the liquid crystal element of the liquid crystal panel can be completed within the one display period.

According to another aspect of the invention, in the liquid crystal display device, the level of the output data is compressed by a specific depth in such a manner that the level of the output data when the delayed display data and the current display data have the same value becomes lower than the level of the current display data, and a lowering of a luminance of the liquid crystal panel based on the compression of the output data is compensated by raising the luminance of a backlighting of the liquid crystal panel.

According to this, by compensating the lowering of the luminance due to the level compression of the display data with the backlighting, the optical response of the liquid crystal element of the liquid crystal panel can be completed within the one display period, and also the display state with a desirable luminance can be achieved.

BRIEF DESCRIPTION OF THE DRAWINGS

Preferred embodiments of the present invention will be described in detail based on the followings, wherein:

FIG. 3 illustrates an example of data for use in the reference table memory relating to the Embodiment 1;

FIG. 4 illustrates an example of data for use in the reference table memory of the liquid crystal display device relating to the Embodiment 2 of the invention;

DESCRIPTION OF PREFERED EMBODIMENTS

Figure 1A:
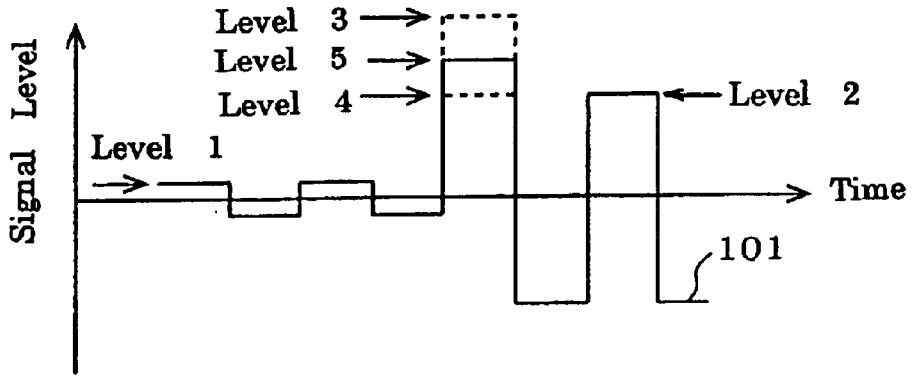
FIG. 1 is a graph illustrating the electrical signal waveform and the optical response waveform to describe the principle of compensation relating to the invention.
Figure 1B:
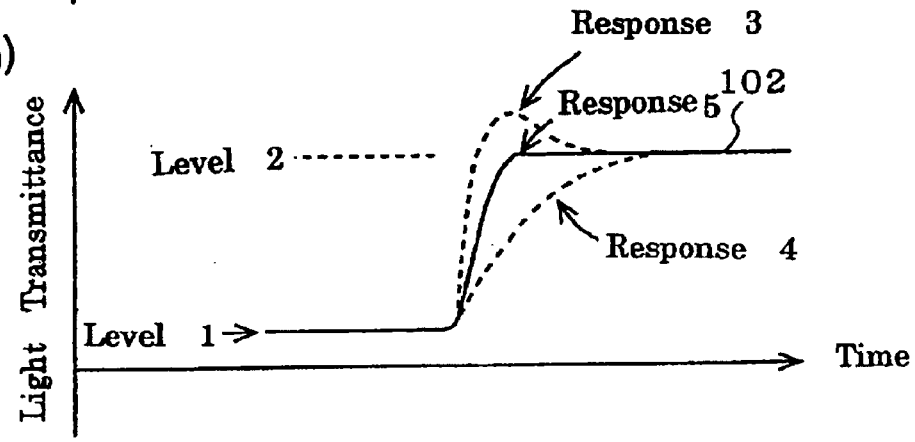

At the beginning, the concept of the present invention will be described with reference to FIG. 1. As shown in the graph of FIG. 1(*a*), the horizontal axis represents the time, and the vertical axis represents the signal level of an electrical signal waveform 101. And, FIG. 1(*b*) represents the light transmittance of an optical response waveform 102 of a liquid crystal element of the liquid crystal panel to which the electrical signal waveform 101 is applied. FIG. 1(*b*) shows the record of variations in the optical response of the liquid crystal element when the signal level of the electrical signal waveform 101 varies from a low signal level 1 to a high signal level 2. And a level 1 in the light transmittance shows a light transmittance of the liquid crystal element when the electrical signal waveform 101 is in the low signal level 1. Also, a level 2 of the light transmittance shows a light transmittance of the liquid crystal element when the electrical signal waveform 101 is in the high signal level 2.

Signal levels 3, 4 and 5 represent the signal levels compensated for accelerating the movement of the liquid crystal element when switched from the low signal level 1 into the high signal level 2. These compensated signal levels 3, 4 and 5 are the signal levels in which the original signal level 2 is compensated, and are outputted during one display period. When this compensated accelerating signal levels are excessive, such as the signal level 3, the optical response waveform 102 will overshoot as shown by a response 3; and also, when the compensation for the signal level is too little in quantity, such as signal level 4, the response of the optical response waveform is not completed within the one display period as shown by a response 4. By selecting an optimum compensation signal level such as the level 5, the response of the optical response waveform can be completed precisely in the one display period as shown by a response 5.

The compensated accelerating signal level can be determined optimum value uniquely by the initial signal level 1 and the signal level 2 after switching the display. Therefore, the first method of the invention measures in advance the compensation signal levels covering all the variations of data to be displayed, prepares these as a table, thereby picks out, when the display signal level changes, a compensation signal level that completes the optical response within the one display period neither too much nor too less from the signal level before switching (the delay display data) and the signal level after switching (the current display data), and applies the compensation signal level to the liquid crystal panel.

For example, the liquid crystal panel that can display n gradations has $n^2$ combination patterns of display switching. Therefore, the method stores $n^2$ compensation signal levels in a ROM (Read Only Memory), for example, as a table.

Here, when the target value of change of the original signal level is either the maximum or the minimum value of the signal level, the compensation signal cannot be generated. In such a case, the problem can be solved by compressing the original signal level. In other words, the second method relating to the invention compresses the signal level invariably at a certain rate to thereby produce a margin to the signal level, lowers the maximum signal level when there is a signal change toward the maximum signal level, and generates the compensation signal level by using the produced margin.

And in the second method, since the maximum signal level after compression becomes lower than the maximum value of the original signal level, the second method compensates a fall of the light transmittance of the liquid crystal panel due to this lowering by raising the luminance of the backlighting of the liquid crystal panel so as not to give any sense of incongruity to human eyes.

The Embodiment 1

Figure 2:
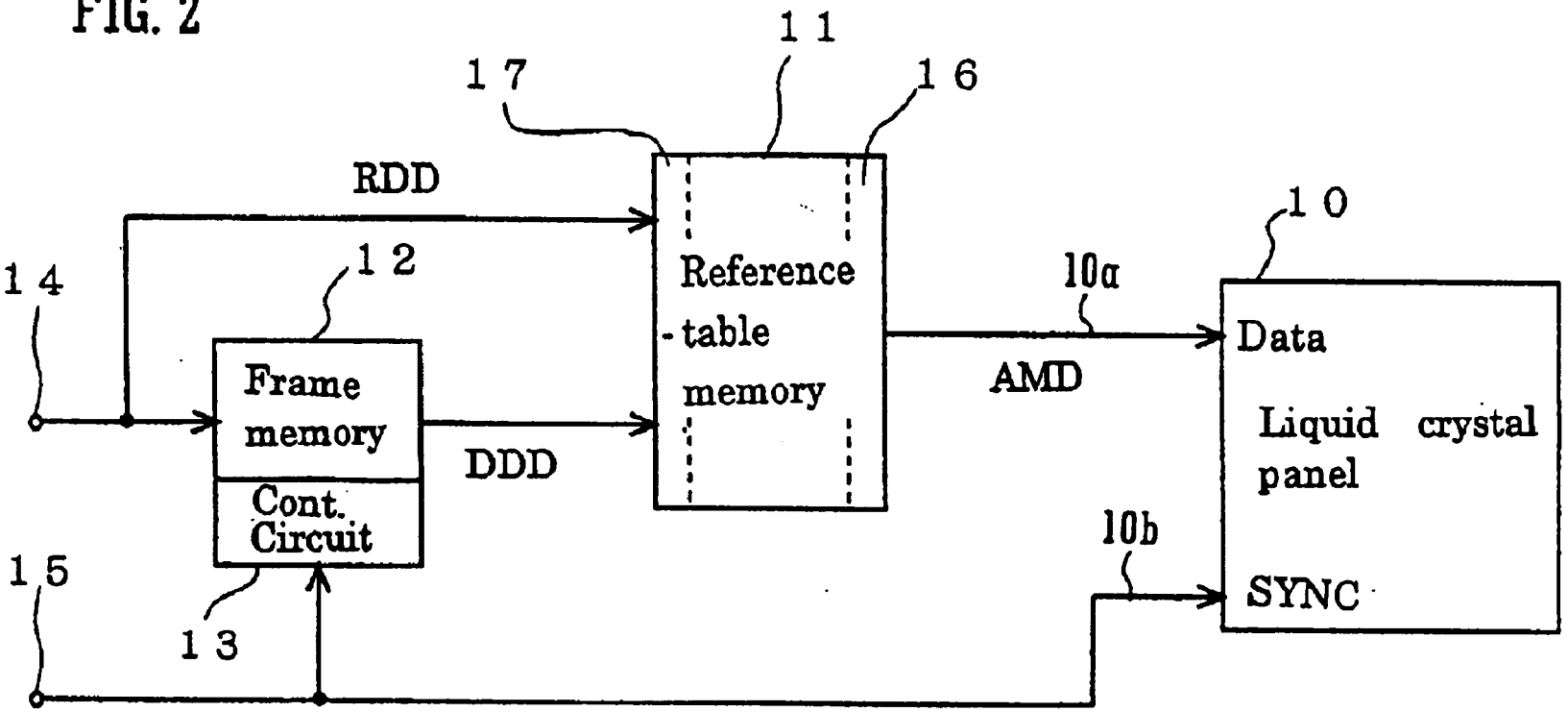
FIG. 2 is a block diagram illustrating a major circuit configuration of the liquid crystal display device relating to the Embodiment 1 of the invention.

FIG. 2 is a block diagram of a liquid crystal panel drive circuit for generating a drive signal waveform related to the Embodiment 1 of the invention. In the block diagram, 10 signifies a liquid crystal panel of the liquid crystal display device, which includes a data input unit 10*a* and a synchronizing signal input unit 10*b*. 11 signifies a reference unit, which includes a reference table memory (compensation data ROM). 12 signifies a frame memory, 13 a control circuit, 14 a data input terminal, and the current display data RDD is supplied to this data input terminal 14. 15 signifies a synchronizing signal input terminal, 16 a data bus for the reference table memory 11, and 17 an address bus also for the reference table memory 11.

The liquid crystal panel 10 of the liquid crystal display device usually inputs display data in a form of digital data, and the display data of this circuit are also assumed as digital. Here, the number of display signal levels, that is, the number of the display data is assumed to be 8 bits with 256 gradations. Since the number of the display data is 256, the number of the compensation signal level data to be prepared in advance is 256. Therefore, by using the compensation data ROM 11 that comprises an 8 bit data bus 16 and a 16 bit address bus 17, all the data can be stored.

A current display data RDD inputted through the input terminal 14 is inputted to the 8 bits address bus of the address bus 17 of the reference table memory 11, and also inputted to the frame memory 12 at the same time. A delayed display data DDD, which is delayed by the one display period, is outputted from the frame memory 12, and this delayed display data DDD is inputted to the remaining 8 bits address bus of the reference table memory 11. The reference data are written in advance as a table into the reference table memory 11, with which the optical response of a liquid crystal element is compensated so as to be completed within the one display period neither too much nor too less, when the signal level changes in all the combinations of the signal level changes relating to the current display data RDD and the delayed display data DDD. The data possesses multiple reference values written in the matrix of 256×256. FIG. 3 represents a part of the reference data. The reference data in FIG. 3 is a matrix data corresponding to the previous display data arrayed in the vertical direction (the delayed display data DDD) and the current displayed data RDD arrayed in the horizontal direction, which includes 256 types of reference values from 0 to 255. Naturally, these reference values are stored digitally inside the reference table memory 11.

Preparing such a circuit configuration and the reference table memory (ROM) in which the compensation data is written, and selecting, from the reference data stored in this reference table memory, a reference value determined on the basis of the signal level of the current display data RDD to be presently displayed and the signal level of the delayed display data DDD before the one display period, and applying the display signal level corresponding to this reference value as a compensation data AMD to the liquid crystal panel 10 will achieve a display of a high speed response at the switching of any signal levels.

The Embodiment 2

Next, a concrete method of generating the compensation signal while always compressing the original signal will be described. In a liquid crystal panel that can provide displays of 8 bits, namely, 256 levels, a data compression standard of 200/256, for example, is set. If the signal level before the one display period (the delayed display data DDD) is equal to the current signal level (the current display data RDD), the diagonal value on the table in FIG. 3, for example, will be selected as the compensation data AMD, but in the Embodiment 1, the data of the original signal level was written here on the diagonal as it was. In this Embodiment 2, as shown in FIG. 4, as a data when the signal level before the one display period (the delayed display data DDD) is equal to the current signal level (the current display data RDD), the data in which the original data is compressed to 200/256 (compression depth is 256 minus 200) is provided in advance on the diagonal of the table.

Figure 5:
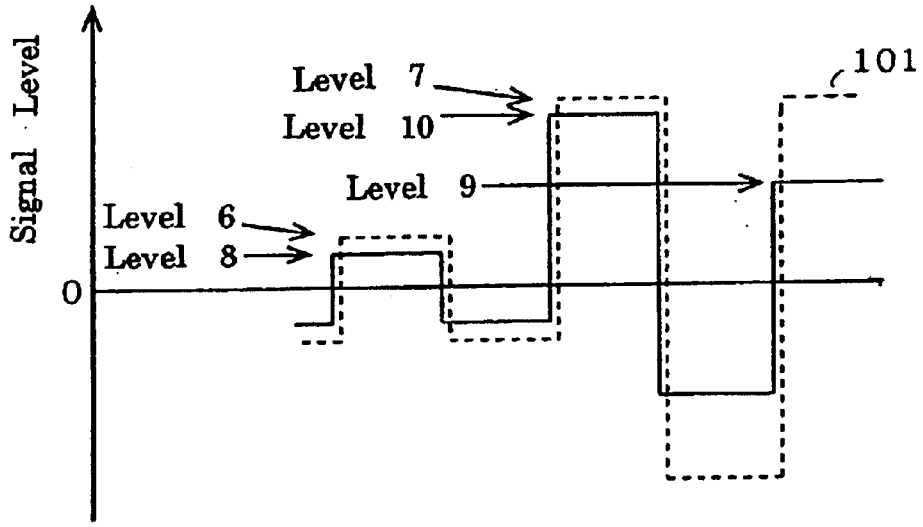
FIG. 5 illustrates an electrical signal waveform compensated by the Embodiment 2.

With this arrangement, if the signal level of the original data is 256, the output signal level will be 200, and as a result of giving the compression depth, the remaining signal levels from 201 to 256 can be used for a generation of the compensation signal. FIG. 5 represents the time-varying characteristics of the electrical signal level when the liquid crystal panel is driven using this method. The dashed line represents the original signal waveform 101, and the solid line represents a compensated signal waveform 101A. When the original signal waveform 101 represented by the dashed line changes from a signal level 6 to a maximum signal level 7, the signal levels 6 and 7 are each compressed to 200/256, and become new signals 8 and 9 represented by the solid line. And, as shown by the signal level 10, the compensation signal is generated so that the signal level is increased within the compression depth.

The Embodiment 3

Figure 6:
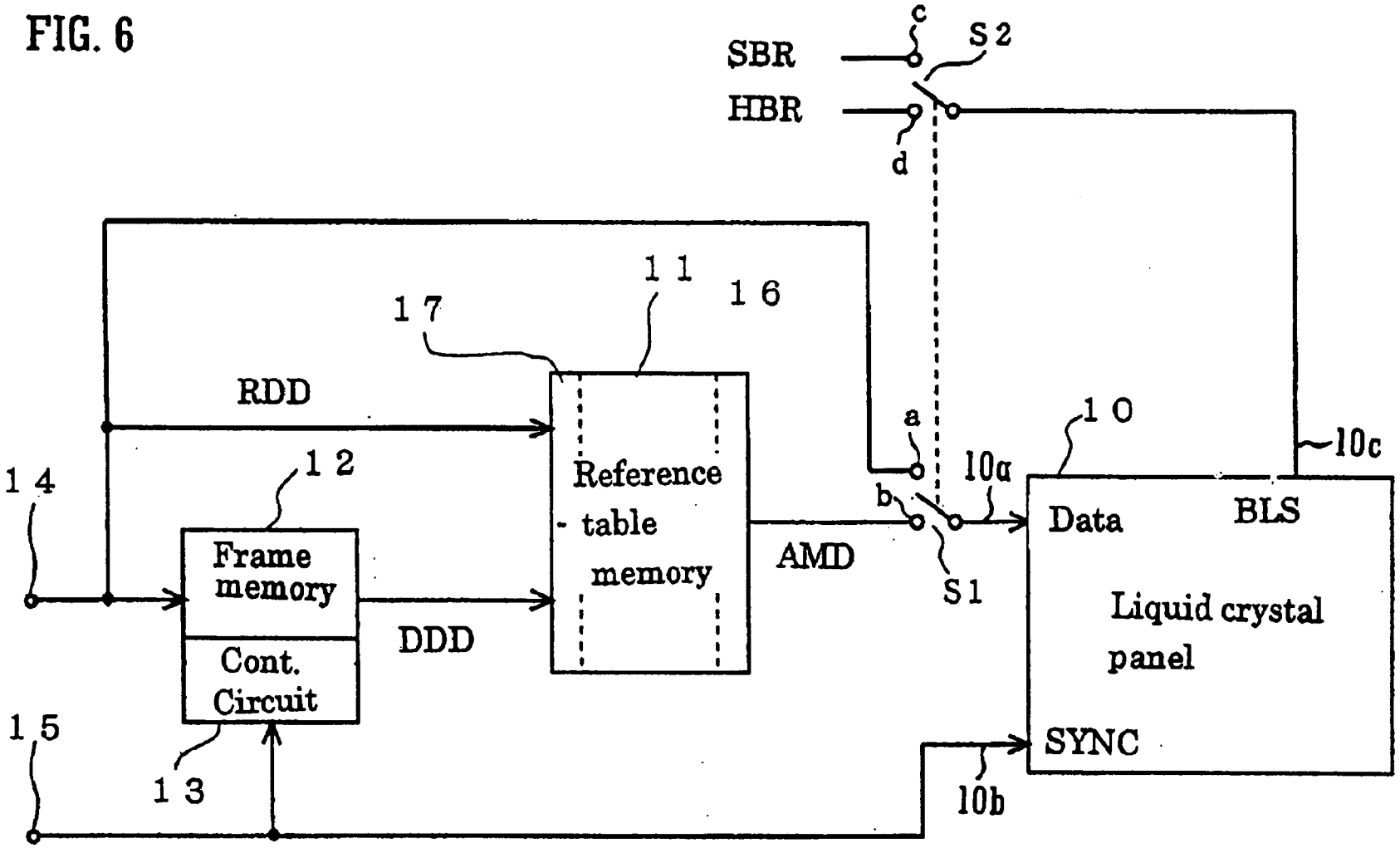
FIG. 6 is a block diagram illustrating a major circuit configuration of the liquid crystal display device relating to the Embodiment 3 of the invention.
Figure 7A:
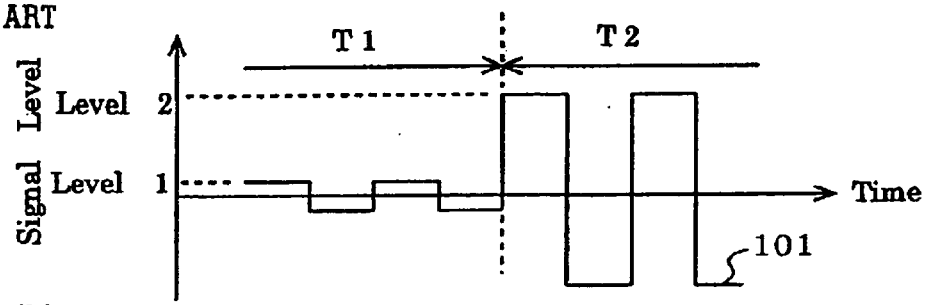
FIG. 7(a) PRIOR ART
FIG. 7 illustrates an electrical signal waveform and an optical response waveform of the conventional liquid crystal display device.
Figure 7B:
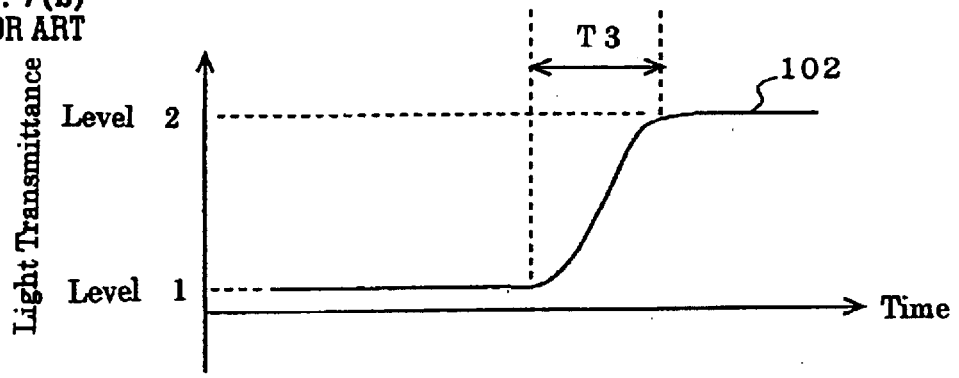
FIG. 7(b) PRIOR ART
Figure 8A:
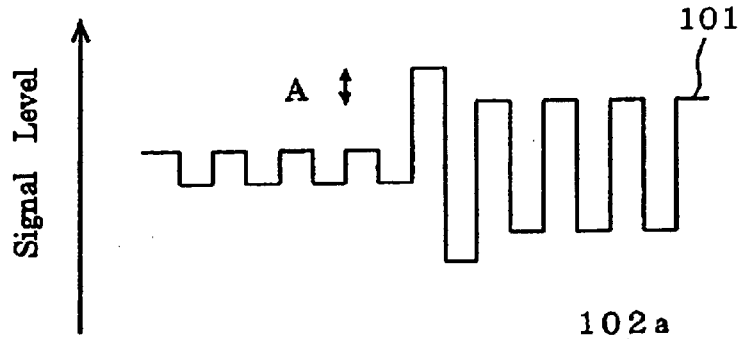
FIG. 8(a) PRIOR ART
FIG. 8 illustrates an electrical signal waveform and an optical response waveform of the liquid crystal display device by conventional compensation method.
Figure 8B:
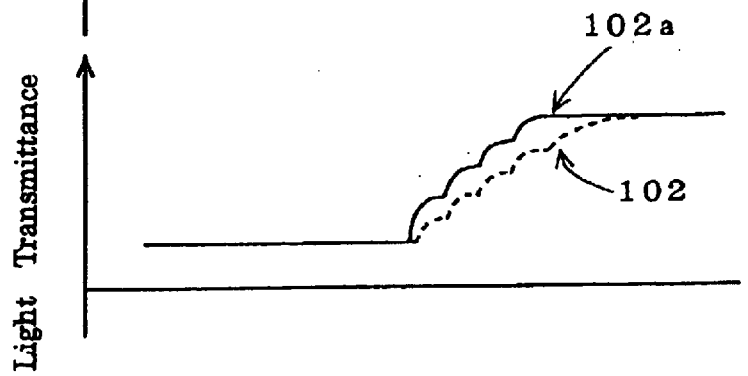
FIG. 8(b) PRIOR ART
Figure 9A:
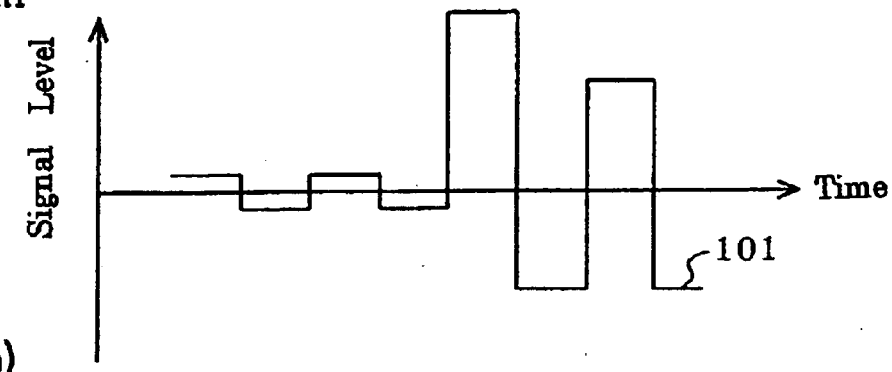
FIG. 9(a) PRIOR ART
FIG. 9 illustrates an electrical signal waveform and an optical response waveform of the liquid crystal display device by conventional compensation method.
Figure 9B:
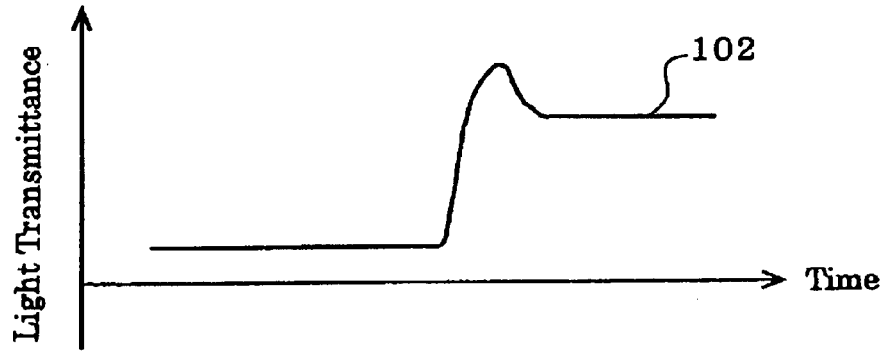
FIG. 9(b) PRIOR ART

In the Embodiment 2, since the signal level supplied to the liquid crystal panel is compressed, the luminance will be lowered on the display. Accordingly, there is a possibility that the difference of the luminance brings about a sense of incongruity, when the liquid crystal panel is switched from the regular drive to the drive with a compression. In that case, as shown in FIG. 6, the signal compression is carried out during driving the liquid crystal panel, in a manner that the switching of the regular drive and the drive with a compression is interlocked with the luminance switching of the backlighting of the liquid crystal panel. And in this case, the luminance of the backlighting is raised to compensate the lowering of the luminance due to the lowering of the signal level, thereby achieving the display state with a desirable luminance.

In FIG. 6, S1 and S2 signify switches that interlock each other. The switch S1 has a regular drive contact a and a compression drive contact b, and the switch S2 has a standard luminance contact c and a high luminance contact d. The movable contact of the switch S1 selects the current display data RDD from the contact a at the regular drive, and the compensation data AMD from the contact b at the compression drive, and supplies the data input unit 10*a* of the liquid crystal panel 10. The movable contact of the switch S2 selects a standard luminance SBR from the contact c at the regular drive, and a high luminance HBR from the contact d at the compression drive, and supplies the selected to a backlighting switch input unit 10*c* of the display panel 10.

According to the present invention being thus described, the data are prepared in advance, with which the response is completed within the one display period neither too much nor too less, as to all the combinations of the signal level changes. Thereby, the response of the liquid crystal panel can be completed within the one display period without generating an overshooting or an undershooting at any signal level changes.

Further, if the original signal is a signal that has a maximum level or a minimum level, the compensation signal for accelerating the movement of the liquid crystal can be generated by means of the signal compression, thereby completing the response of the liquid crystal panel within the one display period.

Also, by compensating the lowering of the luminance due to the signal compression with the backlighting, the response of the liquid crystal panel can be completed within the one display period, and the display state with a desirable luminance can be achieved as well.

What is claimed is:

1. A liquid crystal display device comprising:

a delay circuit that delays an inputted current display data by one display period and outputs a delayed display data;

a reference unit that possesses a reference data containing a plurality of reference values corresponding to both the current display data and the delayed display data, and outputs an output data based on a reference value selected from a plurality of the reference values; and a liquid crystal panel that receives a supply of video signals on the basis of the output data, wherein the reference value selected when the current display data changes from the delayed display data is set so that an optical response of the liquid crystal panel in relation to the change is substantially completed within the one display period.

2. A liquid crystal display device as claimed in claim 1, wherein the level of the output data is compressed by a specific depth in such a manner that the level of the output data when the delayed display data and the current display data have the same value becomes lower than the level of the current display data, and the reference value selected when the current display data becomes higher than the delayed display data is set to expand the output data within the specific depth.

3. A liquid crystal display device as claimed in claim 1, wherein the level of the output data is compressed by a specific depth in such a manner that the level of the output data when the delayed display data and the current display data have the same value becomes lower than the level of the current display data, and a lowering of a luminance of the liquid crystal panel based on the compression of the output data is compensated by raising the luminance of a back-lighting of the liquid crystal panel.

* * * * *